US008727946B2

(12) United States Patent
Greenhill et al.

(10) Patent No.: US 8,727,946 B2
(45) Date of Patent: May 20, 2014

(54) SPOTTING DEVICE

(71) Applicant: Smalley Steel Ring Company, Lake Zurich, IL (US)

(72) Inventors: Michael Greenhill, Highland Park, IL (US); Mark Greenhill, Winnetka, IL (US); Brad Hill, Glenview, IL (US)

(73) Assignee: Smalley Steel Ring Company, Lake Zurich, IL (US)

( * ) Notice: Subject to any disclaimer, the term of this patent is extended or adjusted under 35 U.S.C. 154(b) by 0 days.

(21) Appl. No.: 13/734,386

(22) Filed: Jan. 4, 2013

(65) Prior Publication Data

US 2013/0190143 A1 Jul. 25, 2013

Related U.S. Application Data

(63) Continuation-in-part of application No. 12/774,857, filed on May 6, 2010, now Pat. No. 8,475,338.

(51) Int. Cl.
*A63B 24/00* (2006.01)

(52) U.S. Cl.
USPC ..... 482/5; 482/1; 482/9

(58) Field of Classification Search
USPC ..... 482/1–9, 900–902
See application file for complete search history.

(56) References Cited

U.S. PATENT DOCUMENTS

| | | | | |
|---|---|---|---|---|
| 4,907,797 | A * | 3/1990 | Gezari et al. | 482/9 |
| 4,934,694 | A * | 6/1990 | McIntosh | 482/9 |
| 6,796,926 | B2 * | 9/2004 | Reinkensmeyer et al. | 482/8 |
| 6,852,068 | B2 * | 2/2005 | Ogawa | 482/8 |
| 7,854,685 | B2 * | 12/2010 | Cole et al. | 482/5 |
| 2010/0216600 | A1 * | 8/2010 | Noffsinger et al. | 482/5 |
| 2011/0306467 | A1 * | 12/2011 | Massa | 482/5 |

* cited by examiner

*Primary Examiner* — Glenn Richman
(74) *Attorney, Agent, or Firm* — R. Blake Johnston; DLA Piper LLP US

(57) ABSTRACT

A spotting device for use during exercise routines is provided where a linear motor includes a forcer that travels along a magnetic shaft to provide a resistance force in response to a force generated by a weight in order to provide assistance and safety to a user performing the exercise routine.

29 Claims, 8 Drawing Sheets

SPOTTING DEVICE

RELATED APPLICATIONS

This is a continuation-in-part of U.S. application Ser. No. 12/774,857, filed on May 6, 2010, currently pending, the disclosure of which is hereby incorporated by reference in its entirety.

BACKGROUND

The present technology relates to exercise equipment that utilizes a servo motor system to assist a person during a weight lifting activity. More specifically, the servo motor system may act as a spotter by preventing a weight from falling and contacting a person and potentially injuring a person if a person ceases to fully support the load during a weight lifting activity, or by providing assistance to complete a weight lifting activity by assisting the person in lifting a weight.

In weight or resistance training, spotting is generally the role of a person who acts in support of the person performing a particular exercise. Acting as a spotter generally includes intervening to support a portion of the weight load in order to assist with a lift when the person cannot themselves exert enough force to complete the lift, such as at the end of a series of repetitions, and can also include intervening the support of the entire weight load if the person performing the exercise becomes incapable of doing so.

Spotting is particularly prevalent, and recommended, when performing weight lifting exercises where a person could accidentally drop a weight onto themselves if something goes wrong, such as the bench press, barbell squat, skull crushers, barbell military presses, or barbell push presses. For example, FIGS. 1 and 2 illustrate a first person 10 in a supine position performing a bench press exercise with a barbell, indicated in general at 12, and a second person 14 acting as a spotter. The barbell 12 consists of a horizontally positioned bar 16 that has a bar weight "X," and dead weights 18*a* and 18*b* that stack equally on both ends of the bar 16 to provide additional weights "$Y_1$" and "$Y_2$". The total weight lifted by the first person 10, with reference to FIG. 2, is thus $X+Y_1+Y_2$. In such an example, gravity acting on the barbell 12 serves as the downward force producing element against which the person must act in performing the bench press exercise.

A disadvantage of the approach of FIGS. 1 and 2 is that a second person is required as the spotter. This limits times and locations available for workouts to those when and where a spotter is available. In addition, human spotters are subject to the errors that any human could make, such as providing too much or too little assistance or failing to pay attention during another's exercise routine. A need therefore exists for a spotting device and system whereby a second human spotter is unnecessary.

DETAILED DESCRIPTION

Figure 1:
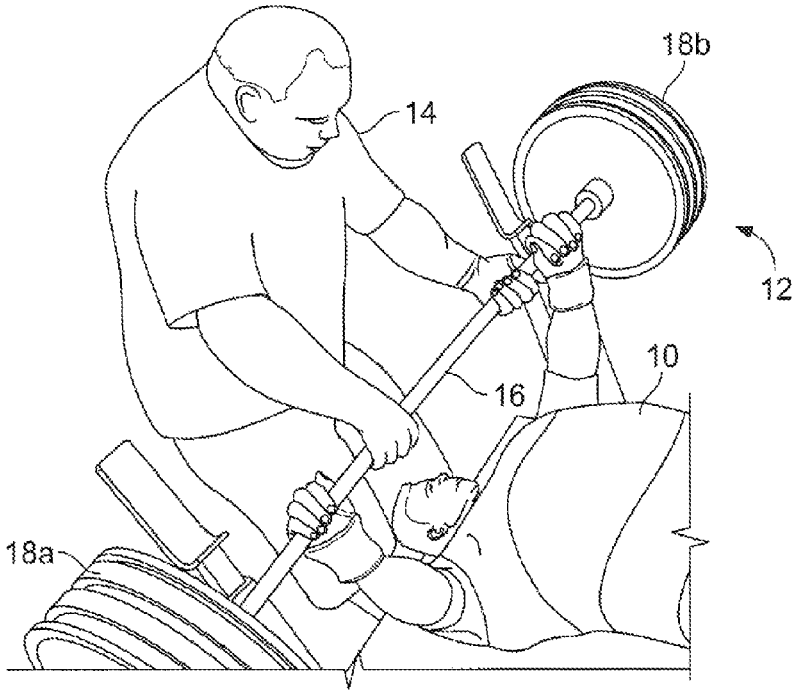
FIG. 1 (Prior Art)
FIGS. 1 and 2 are perspective views of a person performing a bench press exercise with a human spotter in accordance with the prior art.
Figure 2:
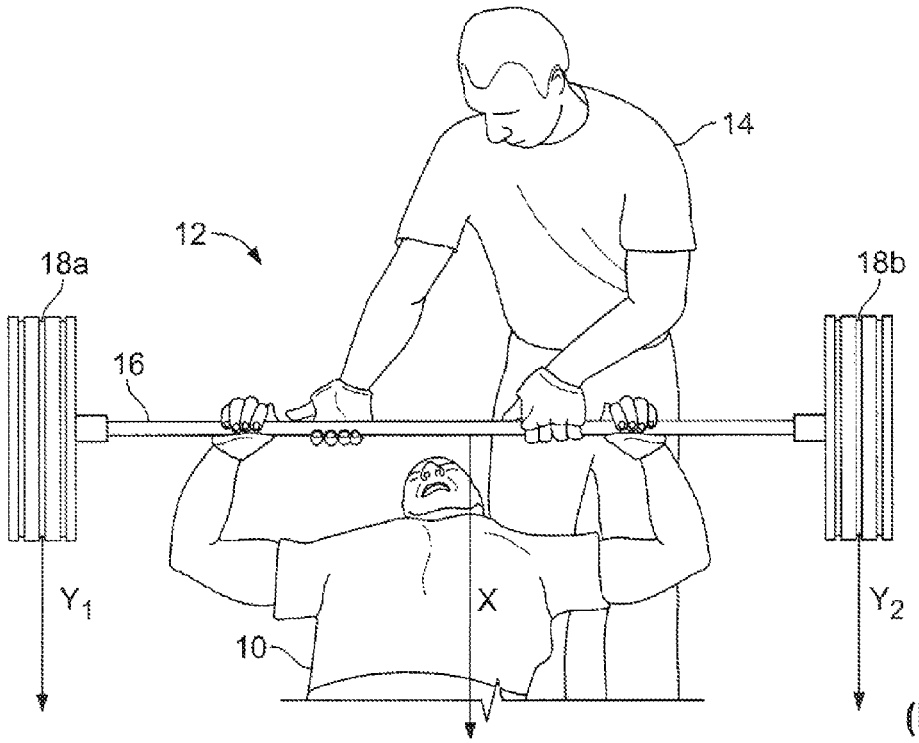
FIG. 2 (Prior Art)
Figure 3:
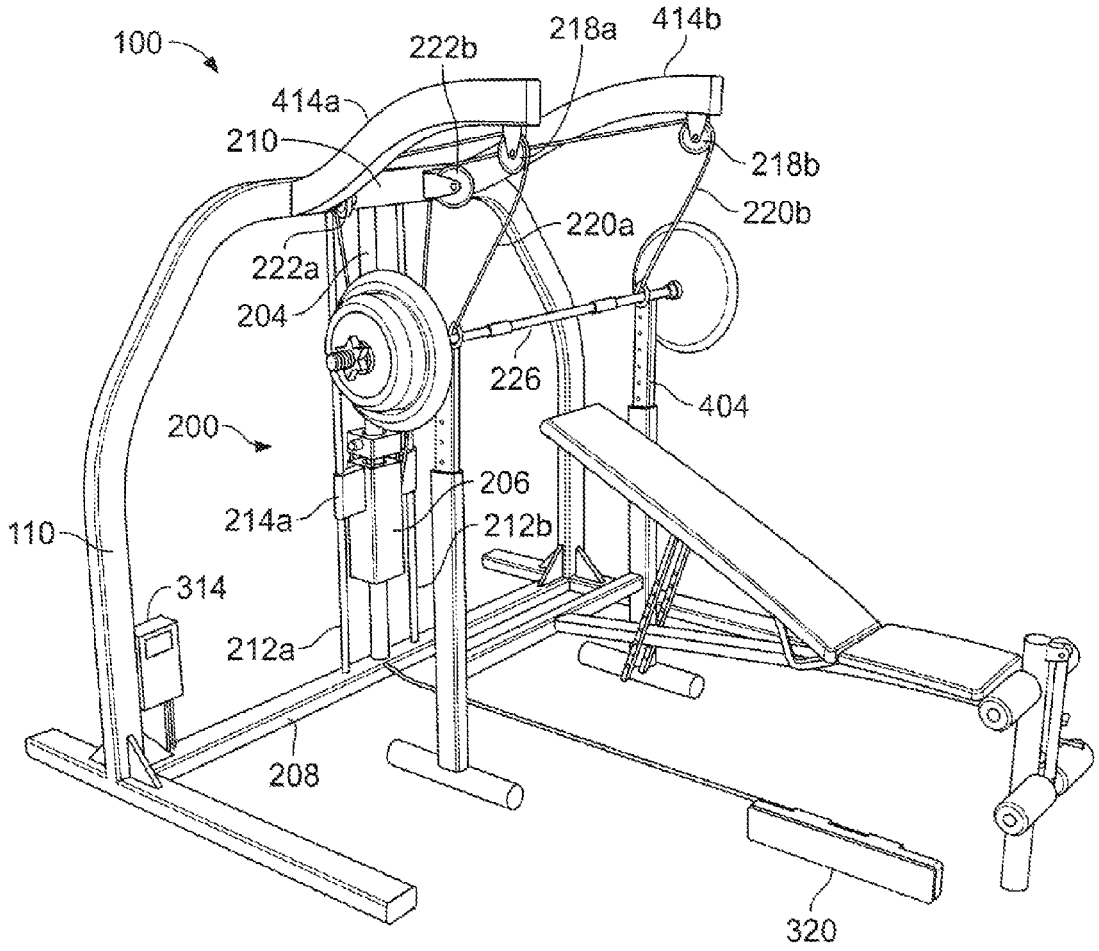
FIG. 3 is a perspective view of a first embodiment of the spotting device of the present invention with a barbell in a resting position on a rack.

The apparatus and system disclosed herein provides a spotting device to assist a person performing a weight lifting exercise. An embodiment of the spotting device of the present invention is indicated in general at 100 in FIG. 3. As illustrated in FIG. 3, the spotting device 100 includes a frame 110 and a linear motor system, indicated in general at 200. The linear motor system 200 includes a forcer 206 that, as explained in greater detail below, acts as a force producing element to provide resistance to a force generated by a barbell 226 being lifted by a user performing a weight lifting exercise. Spotting devices of the present technology can be utilized in activities including, but not limited to, muscle building, strength training, endurance training, rehabilitation, and any other physical fitness application.

A linear motor is as type of servo motor. Servo motors have been incorporated in a wide variety of products and machinery and have been developed and designed according to their particular application requirements. Because of this, servo motors vary widely in form and configuration. Examples of servo motors are AC Servo, DC Brushless Servo, and DC Brushed Servo Motors.

Another distinction in servo motor design is that servo motors may also provide output with either rotary or linear motion. That is, a conventional servo motor has an output shaft that rotates and produces output torque and speed. On the other hand, a linear servo motor is designed to move in a straight line, typically along a magnetic shaft or path, creating force in a linear direction equal to the torque load of rotary servo motors. The spotting device of the invention can incorporate any of the servo motors described above but, for case of description and functionality, a linear servo motor is illustrated as the main component in the embodiment of the spotting device described below.

Linear servo motors as utilized herein have been selected as a preferred type of servo motor that simplifies this application, and can include as magnetic tube or a linear track. A linear tubular servo motor system is described in the illustrated embodiments. A linear motor system includes two magnetic fields that interact to induce or produce a force vector. The first magnetic field is stationary and the second magnetic field moves linearly along a path of travel defined by the first magnetic field.

In the embodiment of the invention presented in FIG. 3, the linear motor system 200 includes a forcer 206 and a magnetic shaft 204, where the forcer is moved along the magnetic shaft as the user lifts the barbell 226 during an exercise routine.

Figure 4:
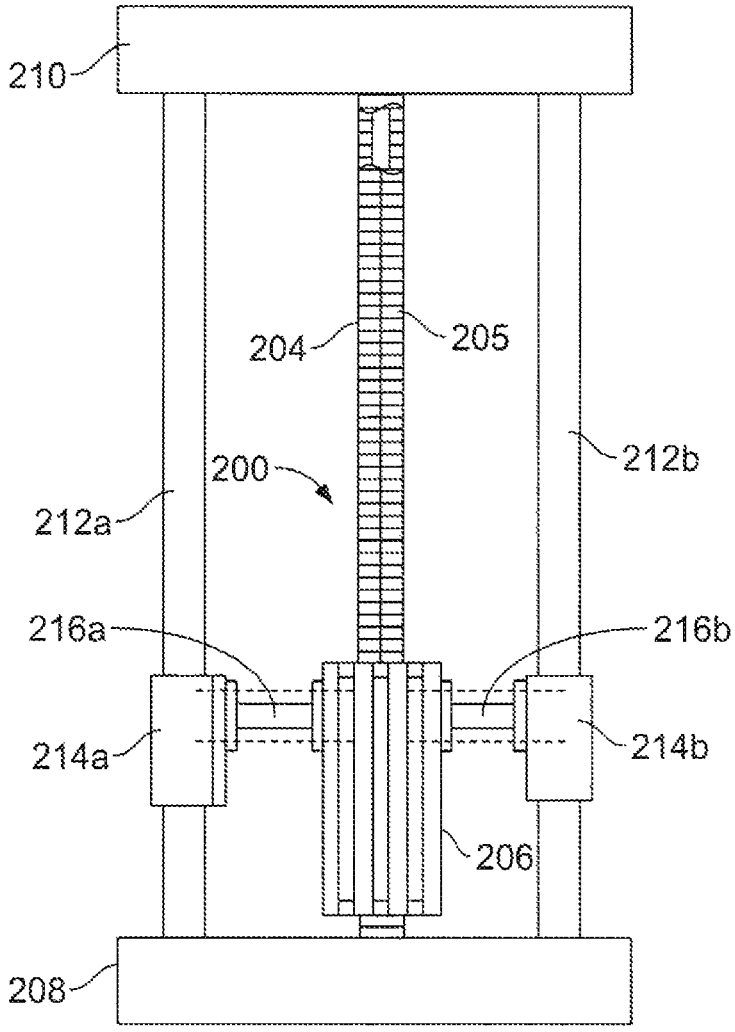
FIG. 4 is a front elevational view of the linear motor and linear motor support structure of the spotting device of FIG. 3.
Figure 5:
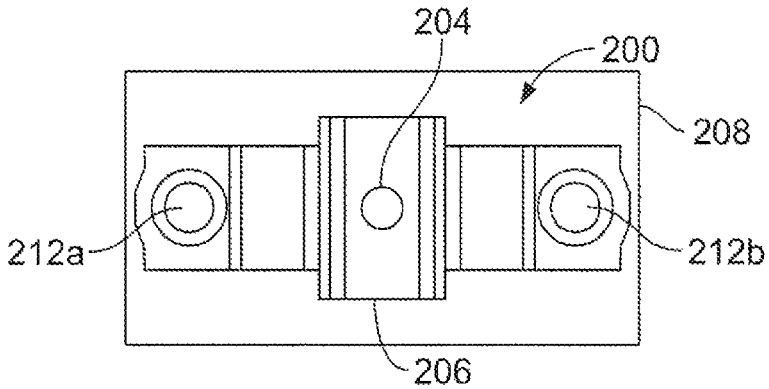
FIG. 5 is a top plan view of the linear motor and linear motor support structure of FIG. 4 with the header support omitted.
Figure 6:
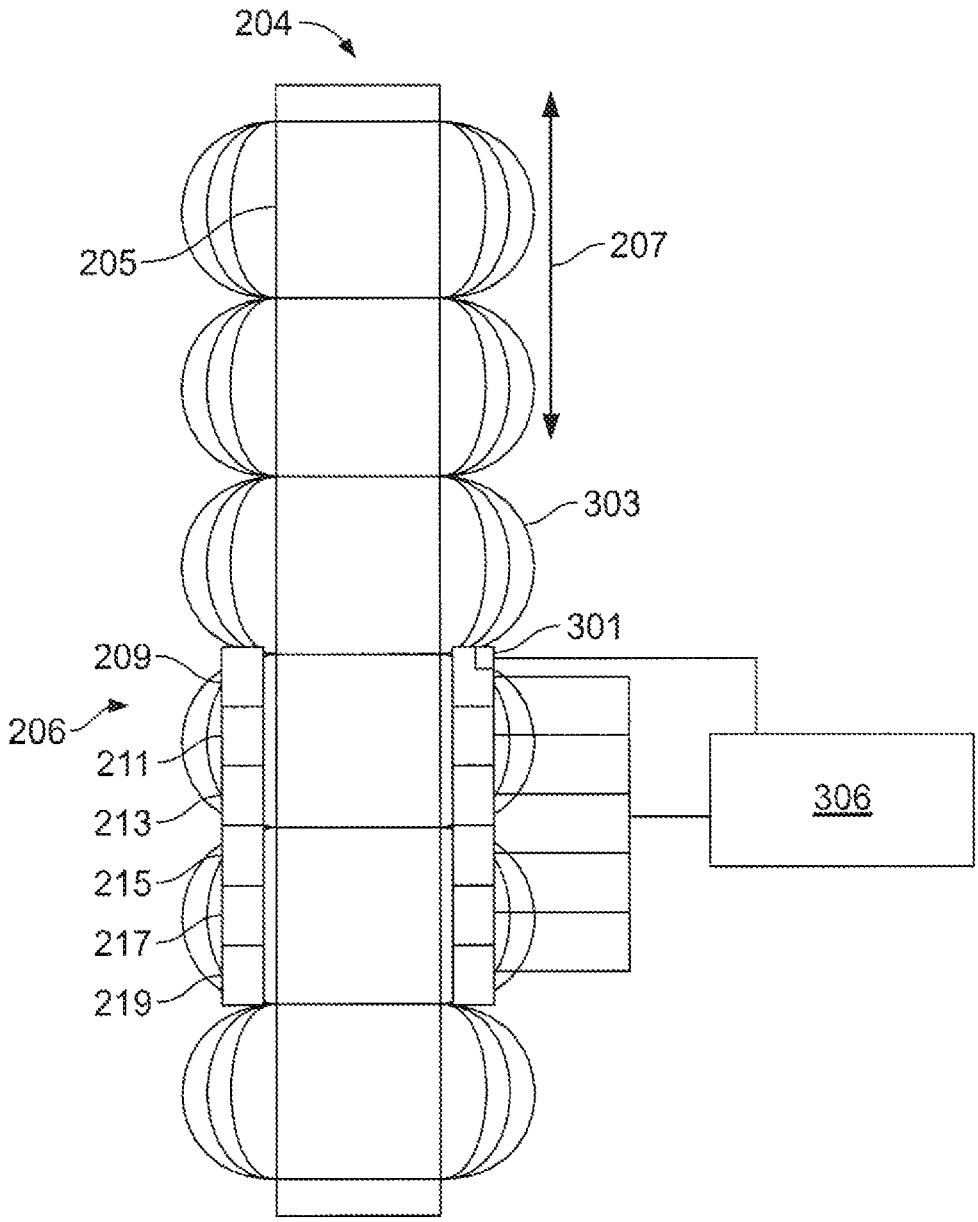
FIG. 6 is a schematic view of the magnetic shaft, forcer and servo drive of the spotting device of FIGS. 3-5.

With reference to FIGS. 4 and 5, the magnetic shaft 204 produces the first magnetic field, and includes a plurality of permanent magnets 205 that are positioned end to end along the path of travel of the forcer, indicated by arrows 207 of FIG. 6. The forcer 206 produces the second magnetic field, which is an electro-magnetic field.

The forcer incorporates a series of coils connected as three phase windings. More specifically, as illustrated in FIG. 6, the forcer 206 includes electric coils 209, 211, 213, 215, 217 and 219 where each surrounds the magnetic shaft 204. The electric coils are electrically isolated from one another and bonded together as a single unit. As is known in the art of electromagnets, the electric coils are wrapped around iron cores. When the coils are excited by a current, such as a three phase current, a magnetic field is created which interacts with the rod magnetic field so as to generate a linear force. The forcer coils have a built-in heat sink and wrap around the magnets of shaft 204 for optimal heat dissipation as well as the most effective use of the magnetic field.

The electromagnetic field produced by the electric coils of the forcer 206 is variable with respect to magnitude by control of the flow of electric current to the coils. The field is also switchable, meaning that it can be generated in any one or more of the electric coils contained within the forcer. As is known in the art of linear motors, a drive, such as a servo drive 306, is utilized to control the magnitude of the electro-magnetic field and sequence the position of the electro-magnetic field between the coils in the forcer 206, in order to produce a linear force when the forcer 206 is in fixed proximity to the stationary magnetic field of the magnetic shaft 204.

With reference to FIGS. 3-5, the linear motor system 200 also includes a support structure that has a base 208, a header support 210, and a pair of linear shafts 212*a* and 212*b* that extend from the base 208 to the header support 210. In the embodiment shown, the base 208 and header support 210 are horizontal, or substantially horizontal, and the linear shafts 212*a* and 212*b* are vertical or substantially vertical. The linear shafts 212*a* and 212*b* are spaced apart, and are preferably parallel or substantially parallel to each other and the magnetic shaft 204, which is positioned there between. The linear shafts 212*a* and 212*b* are connected to the base 208 and the header support 210 in any suitable manner. The linear shafts 212*a* and 212*b* are made of any suitable material, and are preferably made of hardened steel.

The magnetic shaft 204 is also connected to the base 208 and the header support 210 in any suitable manner and is vertical or substantially vertical. The magnetic shaft 204 is preferably centrally located between the linear shafts 212*a* and 212*b*, so that the distance between the center of the magnetic shaft and the center of either linear shaft 212*a* and 212*b* is equal or substantially equal.

The forcer 206 is slidably connected to the linear shafts 212*a* and 212*b* and thus may be linearly displaced along the magnetic shaft 204 when a user raises and lowers barbell 226 (FIG. 3). As a result, as described in greater detail below, a user may calibrate the stroke or displacement of the spotter for a specific exercise. In the embodiment shown, the forcer 206 starts at a home position when the user is in an initial position for performing the exercise. The forcer then moves vertically accounting for the stroke displacement as the user reaches the full stroke of the exercise, and finally returns to the home position as the user finishes the exercise by returning to the initial position.

With reference to FIGS. 4 and 5, the forcer 206 is attached to sleeves 214*a* and 214*b*, where each is provided with linear bearings, by brackets 216*a* and 216*b*. The linear bearings of sleeves 214*a* and 214*b* are slidably attached to the linear shafts 212*a* and 212*b* so that they slide up and down along the linear shafts, and preferably slide with little friction.

Figure 7:
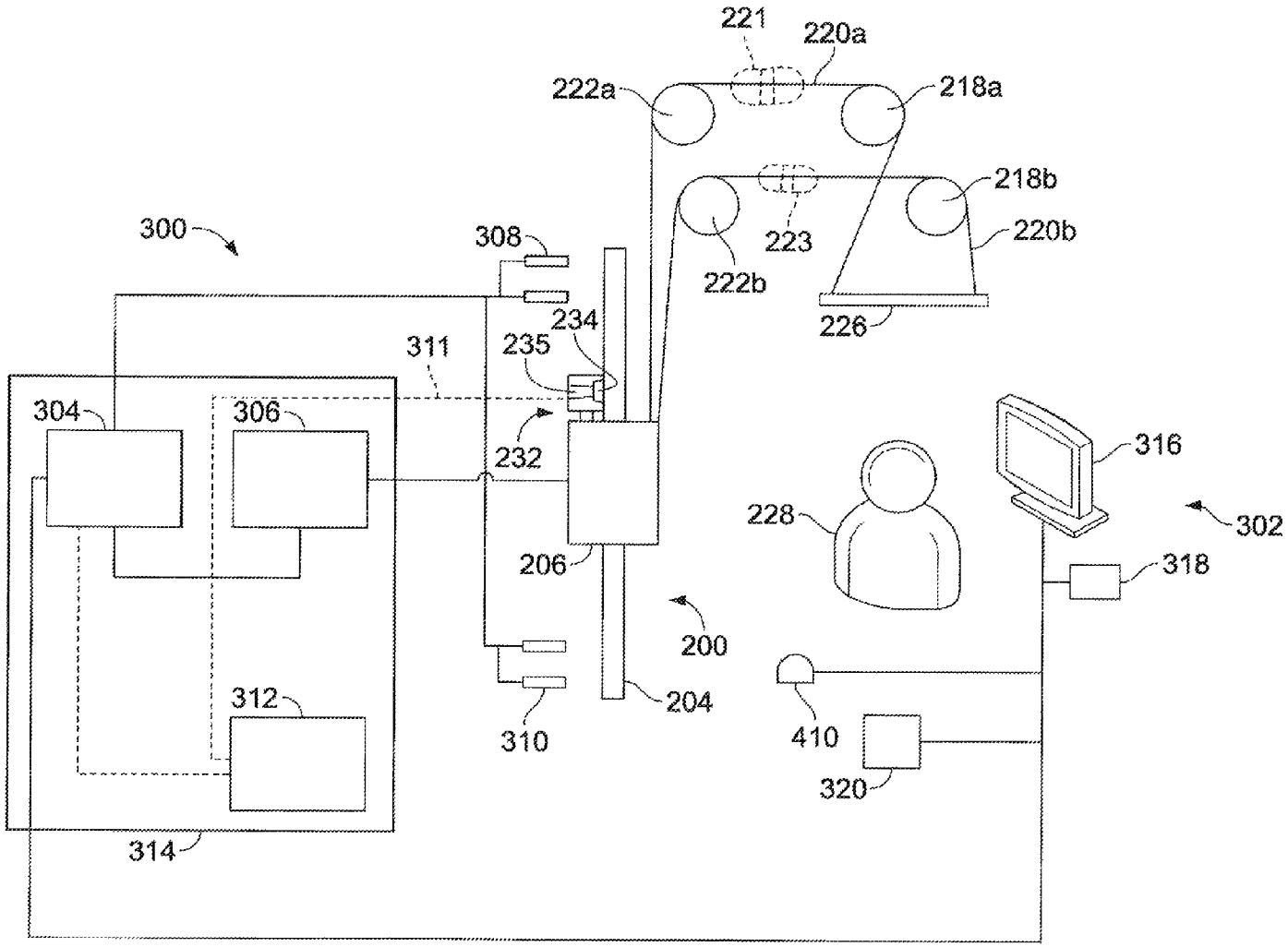
FIG. 7 is a diagram of the control system of the spotting device of FIGS. 3-6.

Referring, to FIGS. 3 and 7, the forcer 206 is mechanically connected to a weight, such as a barbell 226 or other type of weight, which the user 228 manipulates and moves while performing an exercise, by a pulley and cable arrangement. More specifically, four pulleys 218*a*, 218*b*, 222*a* and 222*b*, located on each side of the magnetic shaft 204, are attached to the frame 110 of the spotting device at or near the top of the magnetic shaft 204. Two cables 220*a* and 220*b* are secured to the forcer 206 on each side of the magnetic shaft 204. As illustrated, cable 220*a* passes over pulleys 218*a* and 222*a*, while cable 220*b* passes over pulleys 218*b* and 222*b*. The cables 220*a* and 220*b* may be made of any suitable materials, and are preferably steel cables.

Mechanical adjustments can optionally be incorporated to increase or decrease the force detection generated by the linear motor system 200. For example, adding a pulley block between the barbell 226 and the forcer 206, indicated in phantom at 221 and 223 in FIG. 7, having a motor to user pulley size ratio of 1.5:1 would increase the weight resistance out of the linear motor system 200 by 50% as compared to a motor to user pulley size ratio of 1:1. Conversely, a motor to user pulley size ratio of 1:1.5 would decrease the weight resistance capable of the linear motor system 200 by 50% as compared to a motor to user pulley size ratio of 1:1. Of course the pulley blocks may be positioned elsewhere in the spotting device, as long as they act on the cables connecting the barbell 226 with the forcer 206.

In addition, with reference to FIG. 7, the linear motor system 200 includes a fail-safe brake, indicated in general at 232. The fail-safe brake provides protection to the user in the event of a power loss during an exercise routine. The fail-safe brake is a mechanical means of secondary protection to the user. More specifically, when the electro-magnetic field produced by the forcer 206 is de-energized, the linear motor will not produce any linear force. Thus, when the forcer 206 is de-energized, the linear motor system 200 will not provide any resistance to the force generated by the weight 226 connected to the linear motor system 200, other than the actual physical weight of the forcer 206, the bearings 214 and the brackets 216. Accordingly, if little or no resistance is desired during a portion of an exercise, current can be removed from the electro-magnetic field, de-energizing it. However, in instances when the electro-magnetic field is completely de-energized, such as the result of a power outage or a failure of the linear motor, the tail-safe brake 232 activates and stops the travel of the forcer 206. The brake 232 thus acts as a secondary safety device in order to prevent injury to the user under such circumstances.

The fail-safe brake 232 operates based on friction from an engagement member to prevent movement. For example, with reference to FIG. 7, the engagement member 234 is connected to a driving or engagement/disengagement mechanism 235 and the housing of the brake 232 is securely mounted to the forcer 206. To engage the brake 232, the engagement member 234 is pressed against the magnetic shaft 204 so as to generate friction for deceleration. To disengage the brake 232, the engagement member 234 is pulled away from the magnetic shalt. The engagement/disengagement mechanism 235 for the fail-safe brake can be, for example, spring-applied, permanent magnet, mechanical, electromagnetic, pneumatic, or hydraulic. Utilizing one or more springs, or permanent magnets for the engagement/disengagement mechanism is preferred when the brake 232 is intended to operate as a failsafe in the event of power loss to the system. As illustrated by line 311 of FIG. 7, the fail-safe brake 232 is connected directly to electric input power supply 312 and is actuated when the system detects a power interruption or total power loss.

As an example only, braking systems suitable for use as the fail-safe brake 232 may be obtained front the R.M. Hoffman Company of Sunnyvale, Calif.

Referring to FIG. 7, the linear motor system 200 includes a programmable logic and force generation control system, indicated in general at 300, that is operatively connected to flee forcer 206 and a user interface, indicated in general at 302, that includes a graphical display 316 and an interactive interface 318.

As shown in FIG. 7, the user interface 302 of the programmable logic and force generation control system 300 is operatively connected to a microprocessor 304. A servo drive 306 is operatively connected to the microprocessor 304 and the forcer 206. The microprocessor 304 is programmable to control, via servo drive 306, the resistance provided by the linear motor 200 to the user 228 moving barbell 226 via control of the amount of current to and sequencing of the electric coils of the forcer 206.

One or more positive limit sensors 308 and one or more negative limit sensors 310 are also operatively connected to the microprocessor 304 as is a power supply 312 that provides power to any components of the spotting device as necessary. As illustrated in FIG. 7, the microprocessor 304, servo drive 306 and power supply 312 are housed in a control panel 314.

The microprocessor 304 receives data from the servo drive 306, the user interface 302, the one or more positive limit sensors 308, and the one or more negative limit sensors 310. The servo drive 306 receives data from and sends data to both the microprocessor 304 and the forcer 206, and controls the linear position and velocity of the forcer 206 as dictated by the microprocessor 304.

To aid in smooth and continuous force generation as the motor moves linearly, the programmable logic and force generation control system 300 preferably knows the position of the forcer 206 in relation to the magnetic shaft 204. With this knowledge, precise and controlled sequencing of the electromagnetic fields of the coils 209, 211, 213, 215, 217 and 219 of the forcer can be accomplished as the motor moves so as to maintain a constant magnitude magnetic flux interaction between the electro-magnetic and permanent magnet fields and, subsequently, a constant linear force. As a result, the programmable logic and force generation control system 300 continually monitors the position of the forcer 206 in relation to the magnetic shaft 204. In addition, the programmable logic and force generation control system 300 determines the state of the system by measuring the velocity and direction of linear actuation, during the exercise routine.

As is known in the art, position, direction and velocity of the forcer 206 may be obtained by utilizing a linear encoder. A position sensor, however, preferably is used instead of the linear encoder. Such a position sensor is indicated at 301 in FIG. 6 for electric coil 209 and may be obtained from, as an example only, Copley Controls Corporation of Canton, Mass. Electric coils 211, 213, 215, 217 and 219 may alternatively be provided with the position sensor. Indeed, the position sensor may be positioned generally anywhere on the forcer. The linear motor of FIG. 6 has a sinusoidal varying magnetic field (indicated at 303 in FIG. 6) that provides the output signal for position, direction and velocity. The position sensor 301 outputs analog, differential sine and cosine signals for providing position feedback. The magnetic field, in the case of the linear motor, can generate, for example, 25 micron repeatability and 400 micron accuracy from the non-contact, integral positron sensor placed in the forcer. Position output is industry standard analog at 1V pk-pk sin/cos signals.

In operation of the spotter, the microprocessor 304 stores and executes a program that includes a set of instructions that enables the microprocessor to acquire data, compare values, and execute operations. More specifically, the microprocessor 304 acquires data, such as the position of the forcer 206 along the magnetic shaft 204, and the current being provided to the magnetic coils of the forcer. Microprocessor 304 compares the acquired data to values that are calculated or user-defined, and executes corrective actions to command and control both the magnitude and position of the electro-magnetic field produced by the forcer 206, and hence the force generation of the linear motor 202. In this manner, the microprocessor 304 controls the magnitude of the electromagnetic field, with respect to the position of the forcer 206, in order to increase, decrease, or maintain as constant the linear force generated by the interaction of the two magnetic fields.

The one or more positive limit sensors 308, and the one or more negative limit sensors 310 are positioned to detect the presence of the forcer 206 at locations at or near the endpoints of the magnetic shaft 204. When the presence of the forcer 206 is detected by any of the positive or negative limit sensors 308 and 310, the sensor sends a signal to the microprocessor 304 indicating the presence of the forcer. In response, the microprocessor 304 sends appropriate command data to servo drive 306 to control the magnitude and sequencing of the electro-magnetic field of the forcer 206 as it is about to change direction of movement along magnetic shaft 204. In one preferred example, each of the one or more positive limit sensors 308 and the one or more negative limit sensors 310 have a 25 micron resolution and are analog in nature, allowing the sensor to continuously supply data as quickly as the microprocessor 304 can sample data.

As an example only, sensors suitable for use as the sensors 308 and 310 may be obtained from Omron Corporation of Omron, Iowa.

Figure 8:
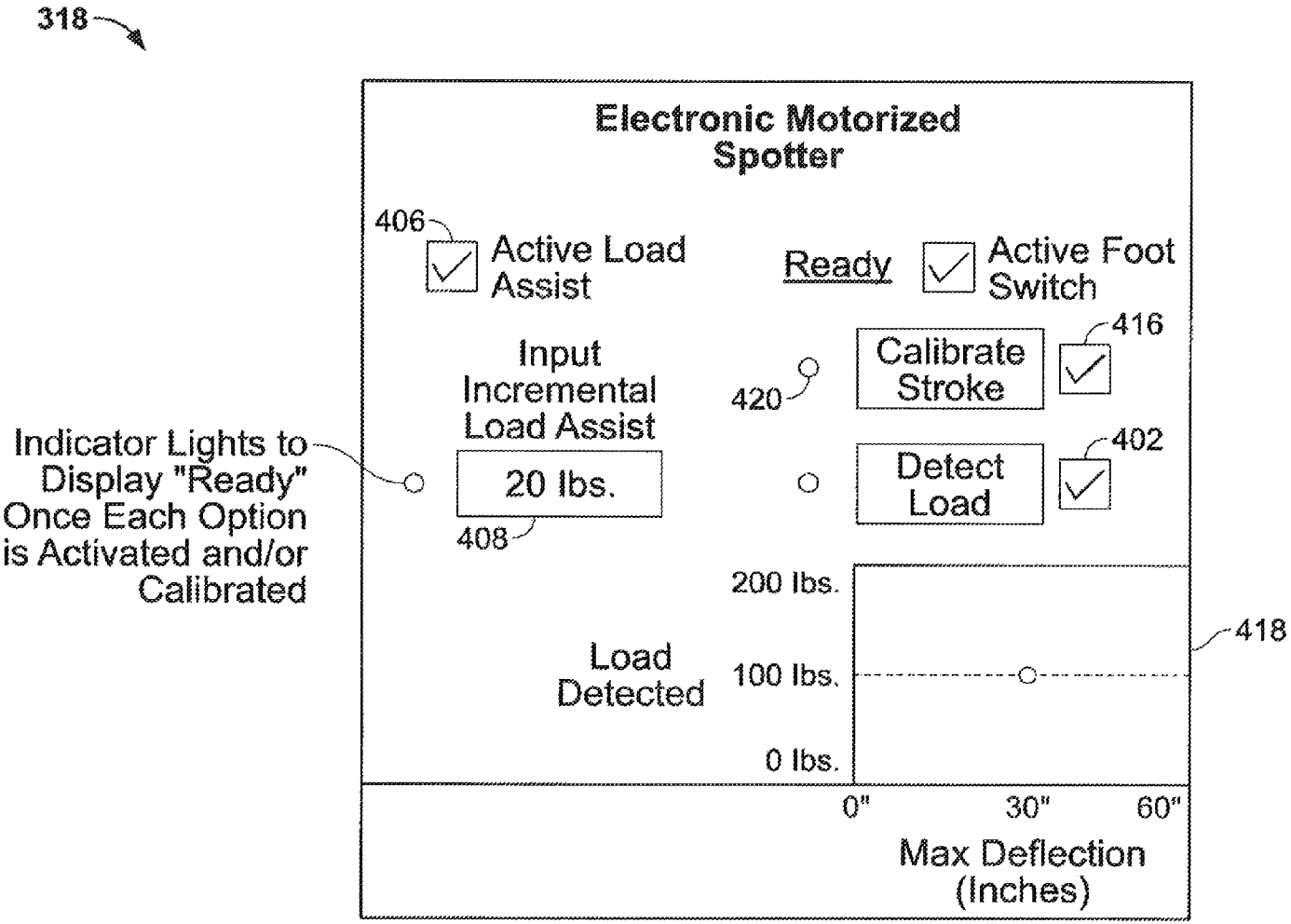
FIG. 8 illustrates the user interface for the spotting device of FIGS. 3-7.

The user interface 302 of the of the programmable logic and force generation control system 300 can be operatively connected to the microprocessor 304 in any suitable manner, including, but not limited to an ethernet connection or a wired connection. The user interlace 302 includes a display 316 featuring a suitable graphical user interface, and can also include an interactive interface 318 configured to allow the user to input data to program operation of the spotting device. The interactive interface 318 can be separate from (as illustrated in FIG. 7) or incorporated into the graphical user interface 316, and can, for example, include at least one of a touch screen, a keypad, or a data transfer link to input the data. In examples utilizing a touch screen and/or a keypad, the user can directly input the data to program parameters for operation of the spotting device. An example of the control panel of the interactive interface 318 of FIG. 7 is provided in FIG. 8.

In embodiments of the spotting device utilizing a data transfer link, the user can transfer data from a computer readable storage medium in order to program the programmable logic and force generation control system 300. Examples of suitable data transfer links include, but are not limited to wireless connections, as well as parallel ports or serial ports. In one example, the interactive interface 318 can include a USB port, and a user can transfer an exercise routine program to the programmable logic and force generation control system 300 from a USB flash memory stick. In other examples, a user can transfer data programmable logic and force generation control system 300 from a personal computer or from a handheld computerized device such as an IPOD or IPHONE.

Utilization of the programmable logic and force generation control system 300 and interactive interface 318 and/or graphical user interface 316 allows the linear motor system to be programmable with regard to resistance level in either the positive negative direction, or both, in order to enable the spotting device to operate as necessary to provide safety to the user performing the weight lifting exercise.

The programmable logic and force generation control system 300 allows the linear motor system 200 to be programmable via the graphical user interface 316 or interactive interface 318 to permit the user to pre-define the amount of weight or resistance that will be necessary to overcome the dead weight of the barbell or object being lifted by the user.

Alternatively, the linear motor system can be configured to determine electronically the amount of resistance needed to support the user's selected barbell dead weight by adjusting the current to the forcer of the linear motor based on the amount of resistance detected by the system when it is connected to the weight 226. More specifically, to make such a determination, the "Detect Load" mode is selected and activated from the panel of FIG. 8 by pressing selector 402. The fully loaded weight 226 is then removed from its resting position on the rack 404 (illustrated in FIG. 3) and allowed to hang by the cables 220*a* and 220*b* of the linear motor system 200. The microprocessor 304 (FIG. 7) of the programmable logic and force generation control system then records the amount of electrical current necessary to counteract the weight of the barbell 226 so as to maintain it at the then present vertical height.

As noted previously, when a user performs the stroke of an exercise, it results in a displacement of the forcer 206 along the magnetic shaft 204, starting at a home position when the user is in the initial position for the exercise and moving through a stroke displacement when the user performs the stroke of the exercise. The programmable logic and force generation control system 300 monitors and records the position of the forcer along with the stroke displacement, which is the maximum distance of travel for the forcer during the given exercise. In addition, the microprocessor of the programmable logic and force generation control system 300 can be programmed and calibrated for each user to identify the exact height at which the user may become injured when a barbell would cross the weight lifter's body, neck or any part of the human body.

The programmable logic and force, generation control system can also be programmed and utilized to apply lilting force to the weight 226, in any incremental force desired, assisting the user in lifting the weight 226 in the event the user desires assistance or determines that assistance is necessary, such as in circumstances including fatigue, loss of muscle strength or control or any reason the user feels the need for assistance in the lifting process. The amount of assistance is input into microprocessor 304 (FIG. 7) by use of the "Active Load Assist" selector 406 (FIG. 8) of the interactive interface 318. More specifically, as the user pushes selector 406, the display 408 toggles from "Off" through the incremental load assist options at ten pound increments (with 20 lbs. being selected in the example presented in FIG. 8). User determination that assistance is desired or necessary is input to the microprocessor 304 of the programmable logic and force generation control system using, for example, a foot switch 320 (FIGS. 3 and 7) or a voice activated command that may be transmitted by the user verbalizing a command to a receive, such as a microphone 410 (FIG. 7). When the user inputs a command for assistance, the programmable logic and generation control system controls the linear motor to add resistance or lifting force to the weight 226 in the pre-programmed amount indicated in display 408 of FIG. 8 set by the user prior to starting the routine.

The microprocessor 304 of the programmable logic and force generation control system can be programmed so that each command by the user for assistance that is input via foot switch 320 or microphone 410 results in the linear motor applying an incrementally larger resistance.

As illustrated in FIG. 3, the spotting device includes a frame 110 that includes beams 414*a* and 414*b* that suspend vertically over the user, or alternatively in any other suitable position, to provide assistance to a user during performance of a weight lifting exercise. Prior to using the spotting device 100, it should be calibrated with the stroke of the exercise and to set a safety stop position of the weight 226 at a predetermined vertical position, that is, a position that the spotting device will prevent the weight 226 from going beyond in a direction towards the user. For example, the safety stop position may be at a vertical height of about 0.5 inches, or another suitable distance, above the user's throat, chest or any part of the user's body that the barbell could fall upon and injure the user.

During calibration of the spotting device 100, the programmable logic and force generation control system monitors and stores information including the amount of linear displacement necessary for a given individual, and the precise vertical position to which the weight 226 will be moved during performance of the exercise. In order to calibrate the system for a particular user, the operator initiates a "Calibrate Stroke" mode by pushing selector 416 of the interactive interface 318 of FIG. 8. Once the "calibrate stroke" mode has been initiated, the linear motor 200 applies a very low resistance force, and the user uses e weight 226 to perform a full stroke of the exercise, or multiple strokes of the exercise, which results in a displacement of the linear motor along it's vertical length of travel.

The microprocessor 304 of the programmable logic and force generation control system 300 then monitors and records the forcer's position during performance of the exercise stroke. The safety stop position, which ma also be called the maximum deflection position, is identified and noted by the microprocessor of the programmable logic and throe generation control system as being the point at which linear displacement of the forcer is at a maximum position. This would typically be the position where the barbell is closest to the user's body and the forcer 206 is at its highest point of travel along the magnetic shaft 204. The maximum deflection position/safety stop position is displayed on the graphical display 418 of the interactive interface 318 (FIG. 8) once it is set. Note that the graphical display 418 of FIG. 8 also displays the weight of the barbell 226 entered or detected in the manner described above. In the example provided in FIG. 8, the barbell 226 has a weight of one hundred pounds and the maximum deflection/safety stop position is thirty inches.

It should also be noted that a small light adjacent to each setup operation, such as indicated at 420 for "Calibrate Stroke," illuminates to indicate to the user that a certain setup step has been completed is "READY" for use.

The spotting device is designed to be used by one individual who can setup and run the machine without assistance. It therefore makes most sense that the calibration setup should be done with no weight on the barbell. This means that in some examples of calibration, the weight 226 that is used during calibration can be the handle of a barbell without any additional weights added thereto. In other examples of calibration, the weight 226 may include the total weight that will be used during the exercise, but this would likely require the assistance of another person.

Figure 9A:
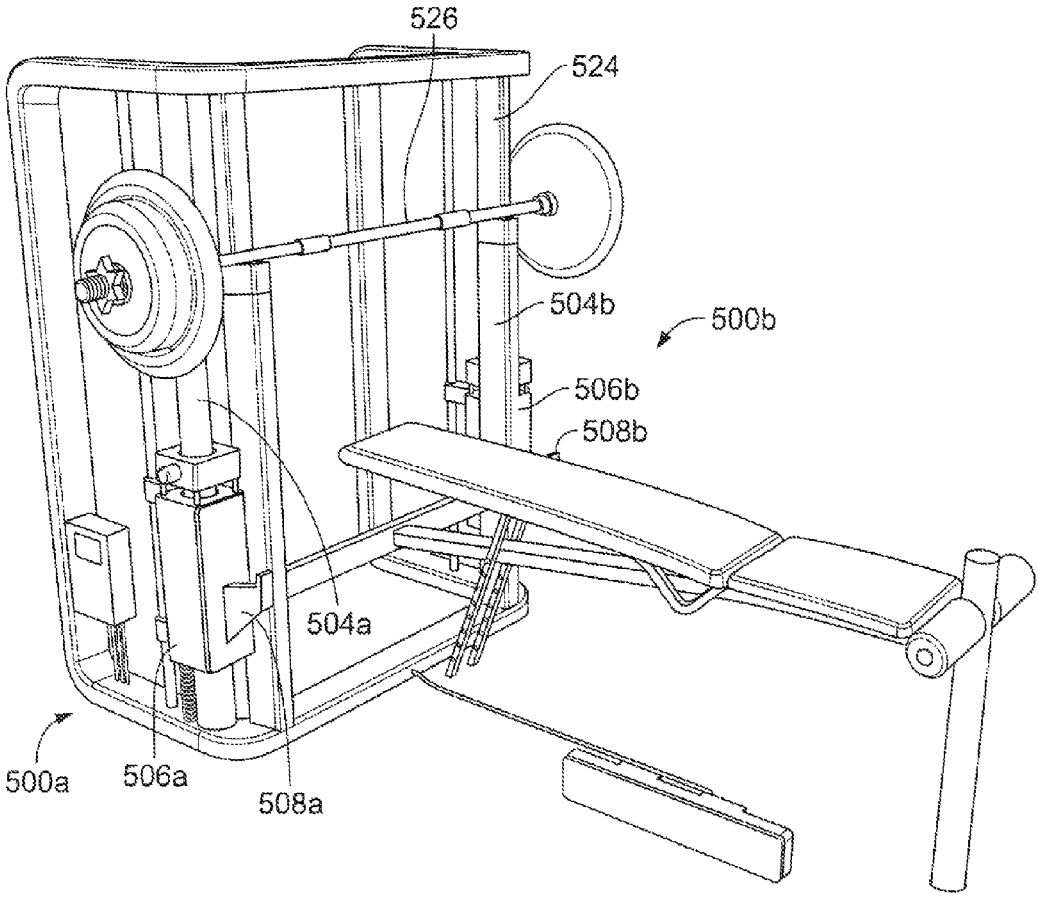
FIGS. 9A and 9B are perspective views of a second embodiment of the spotting, device of the present invention with the a barbell in a resting position on a rack and the barbell in a use position, respectively.
Figure 9B:
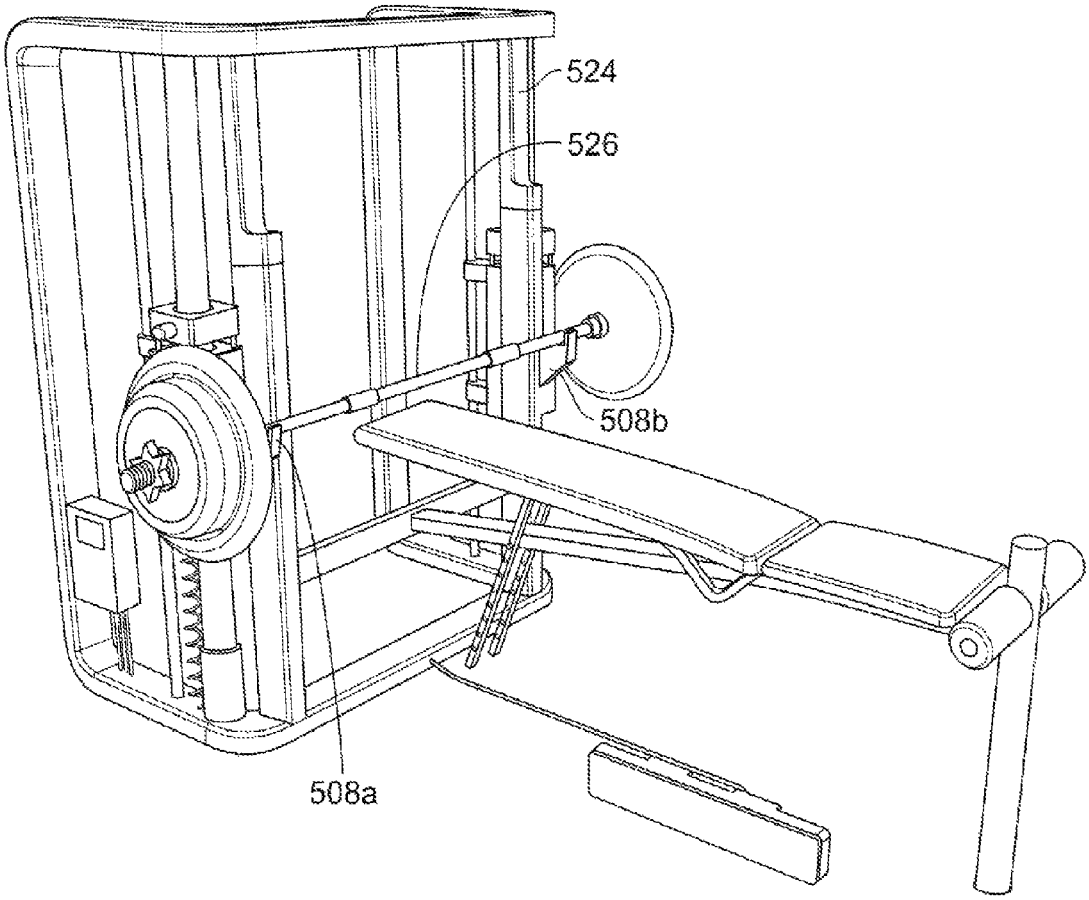

In an alternative embodiment of the invention, illustrated in FIGS. 9A and 9B, the cables 220*a* and 220*b* and pulleys 218*a*, 218*b*, 222*a* and 222*b* of the embodiment of FIG. 3, have been omitted and replaced with twin forcers 506*a* and 506*b* which travel vertically along magnetic shafts 504*a* and 504*b*. Forcers 506*a* and 506*b* each have a construction similar to forcer 206 (FIGS. 3 and 6) while magnetic shafts 504*a* and 504*b* each feature a construction similar to magnetic shaft 204 of FIGS. 3 and 4.

Each magnetic shaft 504*a* and 504*b* of the embodiment of FIGS. 9A and 9B produces a first magnetic field, and includes a plurality of permanent magnets that are spaced along the path of travel of the forcers 506*a* and 506*b*. Each Forcer 506*a* and 506*b* produces the second magnetic field, which is an electro-magnetic field, via electric coils that are electrically isolated from one another and bonded together as a single unit. The electromagnetic fields produced by the electric coils of the forcers 506*a* and 506*b* are variable with respect to magnitude by control of the flow of electric current to the coils. The fields are also switchable, meaning that they can be generated in any one or more of the electric coils within the forcers. As is the case of the embodiment of FIGS. 3 and 6, and known in the art of linear motors, a drive, such as a servo drive, is utilized to control the magnitude of the electro-magnetic field and sequence the position of the electro-magnetic field between the coils in the forcers 506*a* and 506*b* in order to produce a linear force when the forcers are in fixed proximity to the stationary magnetic field of the magnetic shafts 504*a* and 504*b*.

In the embodiment of FIGS. 9A and 9B the forcers 506*a* and 506*b* are provided with hooks 508*a* and 508*b*. In use, the barbell 526 (or other weight) is lifted off of rack 524 and lowered onto the hooks 508*a* and 508*b* by the user. The linear motors 500*a* and 500*b* provided by the corresponding forcers and magnetic shafts then provide assistance to the user in the mariner described with regard to the embodiment of FIGS. 3-8.

It should be noted that, with reference to FIG. 7, the embodiment of FIGS. 9A and 9B require two servo drivers (306 in FIG. 7), one for each of the forcers 506*a* and 506*b*. In addition, four sets of sensors (corresponding to sensors 308 and 310) would be provided—two for each of magnetic shafts 504*a* and 504*b*. The remaining components of the embodiment of FIGS. 9A and 9B, however, are similar to those of FIGS. 3-8 and operate in the same fashion.

From the foregoing, it will be appreciated that although specific examples have been described herein for purposes of illustration, various modifications may be made without deviating from the spirit or scope of this disclosure. It is therefore intended that the foregoing detailed description be regarded as illustrative rather than limiting, and that it be understood that it is the following claims, including all equivalents, that are intended to particularly point out and distinctly claim the claimed subject matter.

What is claimed is:

1. A spotting device that comprises:

a linear motor including a forcer that moves along a magnetic shaft, wherein the linear motor acts as a force producing element and provides resistance to a force generated by a weight being handled by a user;

a base;

a header support; and a pair of linear shafts that extend from the base to the header support, the forcer being slidably attached to the linear shafts, and the magnetic shaft being located between the linear shafts and extending from the base to the header support.

2. The spotting device of claim 1, wherein the resistance provided by the linear motor can be varied in increments of about 0.5 pounds or greater.

3. The spotting device of claim 1, wherein the resistance provided by the linear motor can be provided in a positive direction or a negative direction.

4. The spotting device of claim 1, wherein the linear motor is one type of many programmable servo motors that may be programmed to precisely react to an external force or weight.

5. The spotting device of claim 1, wherein the forcer is linearly displaced in response to the force generated by the weight when the user is performing an exercise.

6. The spotting device of claim 1, wherein the forcer is mechanically connected to the weight to which the user acquires or inputs the force necessary to overcome the load of the dead weights being lifted by the user.

7. The spotting device of claim 6, wherein the forcer is connected to the weight using cables and pulleys.

8. A spotting device that comprises:

a linear motor including a forcer that moves along a magnetic shaft, wherein the linear motor acts as a force producing element and provides resistance to a force generated by a weight being handled by a user;

a programmable logic and force generation control system operatively connected to the linear motor, the programmable logic and force generation control system comprising a microprocessor that is programmable to control the resistance provided by the linear motor.

9. A spotting device that comprises:

a linear motor including a forcer that moves along a magnetic shaft, wherein the linear motor acts as a force producing element and provides resistance to a force generated by a weight being handled by a user;

wherein the forcer is linearly displaced in response to the force generated by the weight when the user is performing an exercise; and wherein the forcer starts at a home position when the weight is in an initial position for performing the exercise, rises vertically to a stroke displacement as the weight reaches a full stroke position when the user performs the exercise, and returns to the home position when the weight returns to the initial position when the user finishes the exercise.

10. A linear motor system for producing a resistance force in a spotting device in response to the force generated by a user supporting a weight, the linear motor system comprising:

a base;

a header support;

a pair of linear shafts that extend from the base to the header support;

a magnetic shaft located between the linear shafts and extending from the base to the header support; and a forcer slidably attached to the linear shafts that moves along the magnetic shaft to produce the resistance force.

11. The linear motor system of claim 10, wherein the linear motor system further comprises a programmable logic and force generation control system operatively connected to the linear motor system, the programmable logic and force generation control system comprising a microprocessor that is programmable to control the resistance provided by the linear motor.

12. The linear motor system of claim 10, wherein the programmable logic and force generation control system further comprises:

a user interface; and a linear position feedback sensor to allow control of the linear position and velocity of the forcer.

13. The linear motor system of claim 12, wherein the user interface comprises graphical user interface.

14. The linear motor system of claim 12, wherein the user interface comprises an interactive interface configured to allow the user to input data to the programmable logic and force generation control system.

15. The linear motor system of claim 14, wherein the interactive interface comprises at last one of a touch screen, a keypad, or a data transfer link.

16. The linear motor system of claim 10, wherein the resistance force provided by the linear motor can be provided in a positive direction or a negative direction.

17. The linear motor system of claim 10, wherein the linear motor is a tubular linear motor.

18. The linear motor system of claim 10, wherein the forcer starts at a home position when the weight is in an initial position for performing the exercise, rises vertically to a stroke displacement as the weight reaches a full stroke position when the user performs the exercise, and returns to the home position when the weight returns to the initial position when the user finishes the exercise.

19. An exercise machine comprising:

a base;

a header support;

a pair of linear shafts that extend from the base to the header support;

a magnetic shaft located between the linear shafts and extending from the base to the header support;

a weight adapted for handling by a user; and a forcer attached to the weight and slidably attached to the linear shafts, where the forcer moves along the magnetic shaft to produce a resistance force that counters a force generated by the weight.

20. The exercise machine of claim 19, wherein the linear motor system further comprises a programmable logic and force generation control system operatively connected to the linear motor system, the programmable logic and force generation control system comprising a microprocessor that is programmable to control the resistance provided by the linear motor.

21. The exercise machine of claim 19, wherein the programmable logic and force generation control system further comprises:

a user interface; and a linear position feedback sensor to allow control of the linear position and velocity of the forcer.

22. The exercise machine of claim 21, wherein the user interface comprises graphical user interface.

23. The exercise machine of claim 21, wherein the user interface comprises an interactive interface configured to allow the user to input data to the programmable logic and force generation control system.

24. The exercise machine of claim 23, wherein the interactive interface comprises at last one of a touch screen, a keypad, or a data transfer link.

25. The exercise machine of claim 19, wherein the resistance force provided by the linear motor can be provided in a positive direction or a negative direction.

26. The exercise machine of claim 19, wherein the linear motor is a tubular linear motor.

27. The exercise machine of claim 19, wherein the forcer starts at a home position when the weight is in an initial position for performing the exercise, rises vertically to a stroke displacement as the weight reaches a full stroke position when the user performs the exercise, and returns to the home position when the weight returns to the initial position when the user finishes the exercise.

28. The exercise machine of claim 19 wherein the exercise machine is a spotting machine.

29. The exercise machine of claim 28 wherein the exercise includes a user moving a weight.

* * * * *